US009993689B1

(12) United States Patent
Wolbert et al.

(10) Patent No.: US 9,993,689 B1
(45) Date of Patent: Jun. 12, 2018

(54) AQUATIC BODY COVER FOR USE WITH A MONOFIN

(71) Applicant: LWBGL SALES, LLC, Redondo Beach, CA (US)

(72) Inventors: Linden Cheri Wolbert, Topanga, CA (US); Russell F. Lesser, Manhattan Beach, CA (US)

(73) Assignee: Mermaids in Motion, LLC, Malibu, CA (US)

( * ) Notice: Subject to any disclaimer, the term of this patent is extended or adjusted under 35 U.S.C. 154(b) by 0 days. days.

(21) Appl. No.: 15/638,243

(22) Filed: Jun. 29, 2017

Related U.S. Application Data

(60) Provisional application No. 62/360,855, filed on Jul. 11, 2016.

(51) Int. Cl.
*A63B 31/11* (2006.01)
*A63B 31/08* (2006.01)
*A63B 31/12* (2006.01)

(52) U.S. Cl.
CPC ..... *A63B 31/11* (2013.01); *A63B 31/12* (2013.01); *A63B 31/08* (2013.01)

(58) Field of Classification Search
CPC ..... A63B 31/00; A63B 31/08; A63B 31/10; A63B 31/11
USPC ..... 2/2.15, 67; 441/60, 64
See application file for complete search history.

(56) References Cited

U.S. PATENT DOCUMENTS 3,344,449 A * 10/1967 Chloe Grilli ..... A63B 31/12 441/60
3,934,290 A * 1/1976 Le Vasseur ..... A63B 31/08 441/60
4,055,174 A * 10/1977 LeVasseur ..... A63B 31/08 441/64
9,162,110 B1 10/2015 Browning et al.
2016/0051860 A1 2/2016 Browning et al.

OTHER PUBLICATIONS

Swimtails Sport Mermaid Tails, http://www.swimtails.com/sport-mermaid-tails/, (2017).

* cited by examiner

*Primary Examiner* — Lars A Olson
(74) *Attorney, Agent, or Firm* — Womble Bond Dickinson (US) LLP

(57) ABSTRACT

An aquatic body cover for use with a monofin. The body cover having a sleeve portion dimensioned to cover a region of a human body extending from a waist to an ankle of the human body and hold the legs substantially together. The body cover further including a foot portion integrally formed with an end of the sleeve portion, wherein the foot portion comprises a first bootie and a second bootie, the first bootie and the second bootie being dimensioned to separately cover each foot of the human body and allow for movement of one foot with respect to the other.

20 Claims, 6 Drawing Sheets

AQUATIC BODY COVER FOR USE WITH A MONOFIN

CROSS-REFERENCE TO RELATED APPLICATION

This application claims the benefit of the earlier filing date of U.S. Provisional Patent Application No. 62/360,855, filed Jul. 11, 2016 and incorporated herein by reference.

FIELD

An aquatic body cover for use with a monofin, more specifically an aquatic body cover in the shape of a mermaid tail dimensioned to cover the hips, legs and feet of a user. Other embodiments are also described and claimed.

BACKGROUND

Many people have at one time or another tried to swim with their feet together using a technique known as the dolphin kick. In an effort to enhance the thrust that can be achieved using the dolphin kick and, in turn, speed of the user, monofins, which consist of a single swim fin attached to both feet, were created. Initially, monofins were developed for competitive sporting applications such as finswimming, freediving and underwater orienteering. More recently, however, monofins are becoming more popular with children and adults alike wanting to use them more recreationally to mimic the swimming movement of a dolphin, mermaid or merman. To further enhance the experience, the monofins themselves are being designed to look more like, for example, a mermaid tail fin. In addition, swimmable mermaid tails have been developed to create the appearance of a mermaid or merman. These swimmable mermaid tails typically consist of a sleeve which is designed to be pulled over the user's legs and also extend over the monofin. Since these conventional swimmable mermaid tails, however, cover both the legs and monofin, it can be difficult for a user to quickly remove the monofin.

SUMMARY

The invention is generally directed to a mermaid tail skin designed for the purposes of swimming, snorkeling, freediving, performance art, skin diving, exercise programs, recreational activities, rehabilitative/physical therapy programs, therapeutic and wellness programs, SCUBA diving, mermaid schools/academies/classes and fantasy costuming on land and in water by children and adults. The mermaid tail skin may be used in conjunction with a corresponding and properly sized monofin, thus giving the appearance, movement and function of a mermaid or merman.

The mermaid tail skin disclosed herein may be constructed from one or a combination of the following materials: swim fabric, neoprene, 2-way or 4-way stretch fabric, spandex (e.g., Lycra®), rubber, plastic, sequins, metallic or other embellishments and silicone materials. In addition, the mermaid tail skin may be constructed of one or more pieces of material, joined together with hook and loop fasteners (e.g., Velcro®), zippers, buttons, clips, snaps, pins, hooks, stitches, magnets, ties, laces, adhesives or other fasteners or closures. The mermaid tail skin may be assembled using one or more pieces of fabric/material sewn or fastened together, with or without added reinforcement of a similar or different material around the ankle, heel and foot areas to add comfort and resilience. Booties having a specific length and distance from one another may be formed at the bottom of the tail. The booties may be designed to fit over and entirely enclose the user's feet. Alternatively, the booties may include stirrups that slide under the user's feet such that portions of the feet are exposed. In addition, the foot "booties" may correspond in length and distance apart to the foot pockets of the corresponding monofin so that once over the feet, the user's feet and booties can be inserted within the foot pockets of the monofin. In other words, the overall length and width of the "leg tube" may vary per size, but the length and distance apart of the foot "booties" will always remain equivalent to the specifically corresponding monofin it is to be paired with.

More specifically, in one embodiment, the invention is directed to an aquatic body cover for use with a monofin. The body cover may include a sleeve portion dimensioned to cover a region of a human body extending from a waist to an ankle of the human body and hold the legs substantially together. The cover may further include a foot portion integrally formed with an end of the sleeve portion. The foot portion may include a first bootie and a second bootie, the first bootie and the second bootie being dimensioned to separately cover each foot of the human body and allow for movement of one foot with respect to the other. The sleeve portion may include a tapered shape such that the sleeve portion is narrower near the foot portion than an end of the sleeve portion near the waist. The sleeve portion may be longer than the foot portion. In some cases, at least one of the first bootie or the second bootie comprises a length dimension that is less than a length dimension of the sleeve portion. For example, at least one of the first bootie or the second bootie comprises a length of 10 inches or less. Still further, at least one of the first bootie or the second bootie comprises a width of 5 inches or less. In addition, a spacing between the first bootie and the second bootie is at least 0.5 inches. In some cases, the first bootie and the second bootie are dimensioned for insertion within a first foot pocket and a second foot pocket, respectively, of a monofin. Still further, at least one of the first bootie or the second bootie entirely encloses the foot of the user. In addition, at least one of the first bootie or the second bootie is open at an end integrally formed within the sleeve portion and entirely closed at an opposite end. In other embodiments, at least one of the first bootie or the second bootie are open at an end integrally formed within the sleeve portion and comprise a stirrup at an opposite end, wherein the stirrup is dimensioned to slide under the foot. The sleeve portion and the foot portion may be formed from one single piece of material. The foot portion may further include a reinforcement portion within the foot portion that is aligned with an ankle, a heel or bottom of a foot when the foot is inserted into the foot portion.

In another embodiment, a swimmable mermaid tail skin is disclosed. The skin may include a sleeve portion having a tubular shape dimensioned to cover portions of a torso and legs of a user. The skin may further include a foot portion extending from an end of the sleeve portion. The foot portion may include a first bootie and a second bootie dimensioned to separately cover each foot of the user and each of the first bootie and the second bootie having a length dimension less than that of the sleeve portion. The sleeve portion and the foot portion may be formed of a same material suitable for use in an aquatic environment. The foot portion may include an overall width less than that of a monofin. The first bootie and the second bootie may form closed pockets at the end of the sleeve portion which are dimensioned to completely enclose each foot of the user. In some cases, the tubular shape is tapered toward the end of the sleeve portion.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The following illustration is by way of example and not by way of limitation in the figures of the accompanying drawings in which like references indicate like elements. It should be noted that references to "an" or "one" embodiment in this disclosure are not necessarily to the same embodiment, and such references mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1:
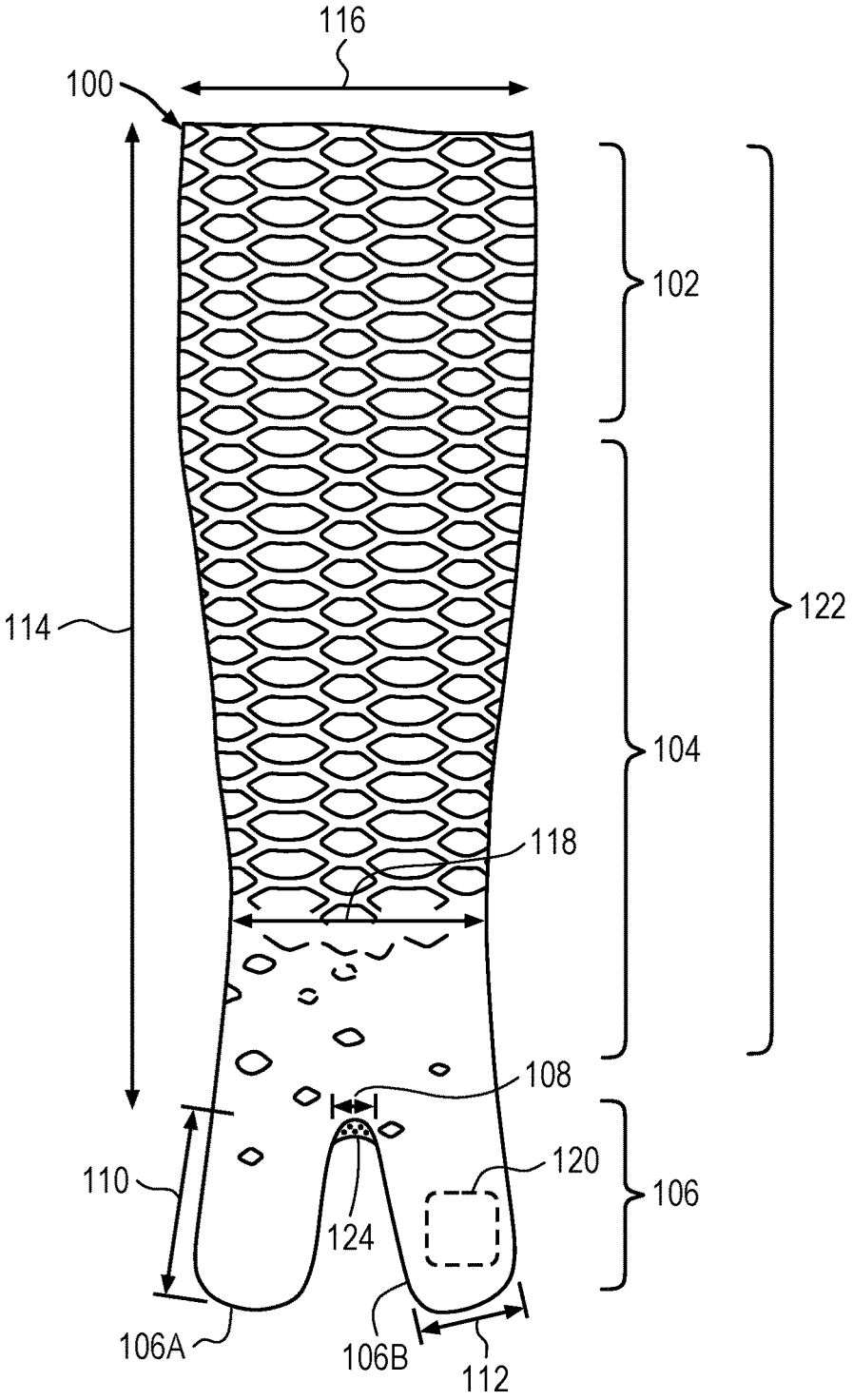
FIG. 1 illustrates a front view of one embodiment of an aquatic body cover.

FIG. 1 illustrates a front view of one embodiment of an aquatic body cover. As can be seen in FIG. 1, in one embodiment, the aquatic body cover is a mermaid tail skin 100. The mermaid tail skin 100 may include a sleeve portion 122 that, in some cases, is tubular and dimensioned to extend from a waist region to an ankle region of the user. In particular, the sleeve portion 122 may include a lower torso section 102 and a leg section 104. The lower torso section 102 is dimensioned to wrap around or otherwise cover the lower torso region of the body (e.g., the waist, hip and buttock regions) while the leg section 104 is dimensioned to wrap around or otherwise cover the legs of the user.

In some embodiments, the sleeve portion 122 is tapered such that it is in the shape of a mermaid tail and fits snugly along the user's legs so that the legs are held together when the user kicks their legs. For example, in one embodiment, the sleeve portion 122 tapers gradually in a direction of the leg section 104 such that the leg section 104 is narrower than the lower torso section 102, or the end of lower torso section 102 near the waist line of the user. Said another way, the lower torso section 102 is wider than the leg section 104. For example, in one embodiment, the lower torso section 102 has a width 116 of from about 5 inches to about 15 inches, or from about 7 inches to about 13 inches, or preferably about 9.5 inches. In still further embodiments, the leg section 104 may have a width 118 less than that of the lower torso section 102, for example, a width of from about 4 inches to about 10 inches, or from about 5 inches to about 7 inches, or preferably about 6.25 inches. The width of the lower torso section 102 and leg section 104 may taper gradually in a direction of the leg section 104 so that it conforms to the shape of the user's lower torso and legs.

The sleeve portion 122 may further include a foot portion 106. The foot portion 106 may, in some embodiments, include a first bootie 106A and a second bootie 106B extending from an end of the leg section 104. The first bootie 106A and the second bootie 106B may be separate from one another such that when a user's feet are inserted into each bootie, the user can move one foot separately from another foot. For example, as can be seen from FIG. 1, first bootie 106A and second bootie 106B form finger like projections extending from the end of the leg section 104. In some embodiments, booties 106A, 106B may be designed to fit over and entirely enclose the user's feet as shown in FIG. 1. Alternatively, the booties may include stirrups that slide under the user's feet such that portions of the feet are exposed, as will be discussed in more detail in reference to FIG. 5. In addition, first and second booties 106A, 106B may correspond in length and distance apart to the foot pockets of a corresponding monofin so that once over the feet, the user's feet and booties can be inserted within the foot pockets of the monofin. In other words, the overall length and width of the sleeve portion may vary in size depending upon the size of the user, while the length and distance apart of booties 106A, 106B may be equivalent to the specifically corresponding monofin it is to be paired with.

More specifically, as can be seen from FIG. 1, each of first bootie 106A and second bootie 106B may be separated by a gap 108 and have a length dimension 110 and a width dimension 112. The gap 108, length dimension 110 and width dimension 112 of booties 106A, 106B may be any size sufficient to allow for a user to insert their feet into the booties 106A, 106B and insert their feet (covered by booties 106A, 106B) within the foot pockets of a monofin. For example, in one embodiment, a length 110 of bootie 106A and/or bootie 106B may be 20 inches or less, for example, from about 2 inches to about 15 inches, or from about 3 inches to about 10 inches, or preferably about 5 inches. In addition, in some embodiments, a width 112 of first bootie 106A and/or bootie 106B may be from about 0.5 inches to about 10 inches, or from about 1.5 inches to about 5 inches, or preferably about 2.75 inches to about 3.5 inches. Still further in some embodiments, gap 108 may be 5 inches or less, for example, from about 0.5 inches to about 3 inches, or from about 0.75 inches to about 1.75 inches, or preferably about 1 inch.

In some embodiments, a vent portion 124 may be formed between bootie 106A and bootie 106B. Vent portion 124 may be positioned within a portion of gap 108 and include openings or pores that allow for air bubbles to escape out the end of foot portion 106. For example, vent portion 124 may be formed by a piece of fabric having openings, pores, or the like that are large enough for air and water to pass through, and allow for venting from tail skin 100, for example, a mesh type of material. Although vent portion 124 is shown within gap 108, it is contemplated that vent portion 124 may be positioned within any portion of tail skin 100 that allows for sufficient venting of air from the skin during use. The specific details and configuration of vent portion 124 will be described in more detail in reference to FIG. 2A and FIG. 2B.

In addition, in some embodiments, the sleeve portion 122 (e.g., the lower torso section 102 and leg section 104) may be longer than the foot portion 106. In some cases, at least one of the first bootie 106A or the second bootie 106B may include a length dimension that is less than a length dimension of the sleeve portion. In other words, the first and second booties 106A, 106B are shorter than the sleeve portion 122. For example, the sleeve portion 122 (including lower torso section 102 and leg section 104) may have a length 114 of from about 15 inches to about 35 inches, or from about 20 inches to about 30 inches, or from about 25 inches to about 29 inches, or preferably about 27.75 inches. In addition, a length of the entire mermaid tail skin 100 (including lower torso section 102, leg section 104 and foot portion 106), in other words length 114 and length 110 as shown in FIG. 1, may be from about 25 to about 50 inches, or from about 30 inches to about 45 inches, or preferably from about 32.75 inches to about 35 inches.

The sleeve portion 122 (including lower torso section 102 and leg section 104) and the foot portion 106 may be one continuous integrally formed structure such that there is no separation in the material used to form the torso section 102, leg section 104 and foot portion 106. For example, in one embodiment, the entire mermaid tail skin 100 may be assembled using one piece of fabric that is sewn, or otherwise attached together, along a single seam. In other embodiments, more than one piece of fabric may be sewn or fastened together.

In addition, in some embodiments, the entire mermaid tail skin 100 may be constructed from one or a combination of two-way or four-way stretch fabrics, or combinations of various fabrics, for example, swim fabric, neoprene, spandex (e.g., Lycra®), rubber, plastic, silicone, materials with sequins, metallic or other embellishments are further contemplated. In addition, the mermaid tail skin 100 may be constructed of one or more pieces or material, joined together along a seam with fabric hook and loop fasteners (e.g., Velcro®), zippers, buttons, clips, snaps, pins, hooks, stitches, magnets, ties, laces, adhesives or other fasteners or closures.

Still further, in some embodiments, mermaid tail skin 100 may include an optional reinforcement member 120 around the ankle, heel and foot areas to add comfort and resilience. For example, reinforcement member 120 may be an additional piece of material (the same or different than the sleeve and foot portions) positioned along an inner (or outer) surface of one or more of first and second booties 106A, 106B. Representative reinforcement members will be discussed in more detail in reference to FIG. 3 and FIG. 4.

It should be understood that the mermaid tail skin 100 is dimensioned for use on any size body, for example, a child or an adult. Accordingly, the sizing of the sleeve portion including the torso section 102 and leg section 104, and the foot portion 106, are suitable for use by a child or an adult. In addition, it should be understood that although specific dimensions are disclosed herein, these are only representative dimensions, and may vary depending on the size of the user, type of material used, or other factors. For example, where the mermaid tail skin 100 is made of a highly resilient fabric that can stretch in multiple directions, the dimensions may be smaller than a tail skin made from a less resilient fabric since the skin can stretch to fit a user much larger than the actual size of the skin.

Figure 2A:
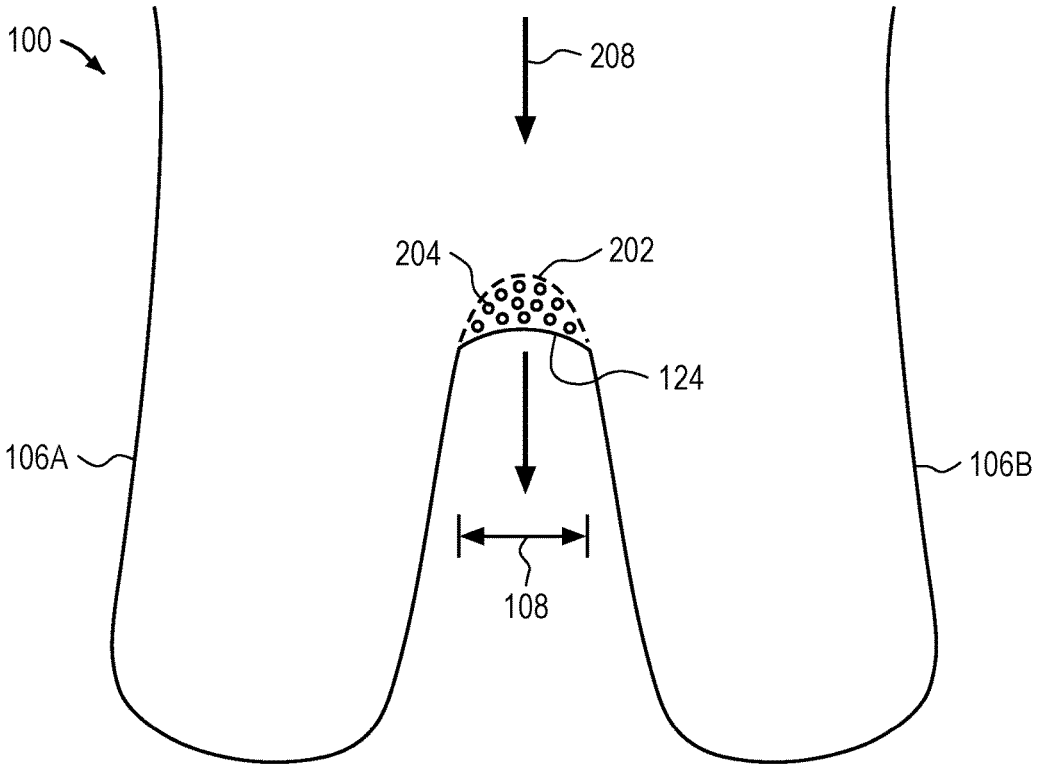
FIG. 2A illustrates a magnified front view of a vent portion of the aquatic body cover of FIG. 1.
Figure 2B:
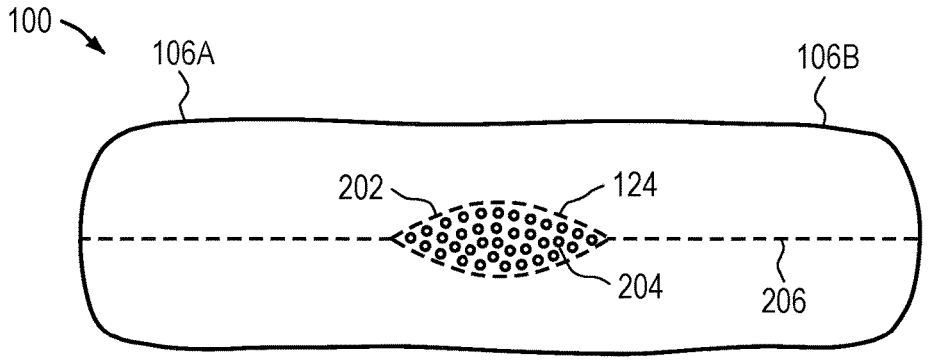
FIG. 2B illustrates a bottom plan view of a vent portion of the aquatic body cover of FIG. 1.

FIG. 2A and FIG. 2B illustrate the vent portion in more detail. Representatively, FIG. 2A illustrates a magnified front view of a vent portion of the aquatic body cover of FIG. 1, and FIG. 2B illustrates a bottom plan view of the vent portion. From this view, it can be seen that vent portion 124 is positioned within gap 108 between booties 106A, 106B. For example, vent portion 124 may be positioned along the seam 206 of booties 106A, 106B, as shown in FIG. 2B. Vent portion 124 allows for air to vent out of skin 100 as illustrated by arrow 208. Vent portion 124 may have any size and/or shape, and be formed of any material, suitable for achieving venting of air bubbles through tail skin 100. Representatively, in one embodiment, vent portion 124 may be made of a piece of material having openings or pores 204, for example, a mesh material. The material may be positioned over an opening formed in a region of foot portion 106, where gap 108 is shown, and sewn to the material used to make foot portion 106A and foot portion 106B along dashed line 202. In this aspect, the material of vent portion 124 may be different than that of tail skin 100. In other embodiments, however, the vent portion 124 may be formed of a same material as tail skin 100, and for example, pores 204 formed within the material to provide venting when the tail skin material is not porous enough.

Figure 3:
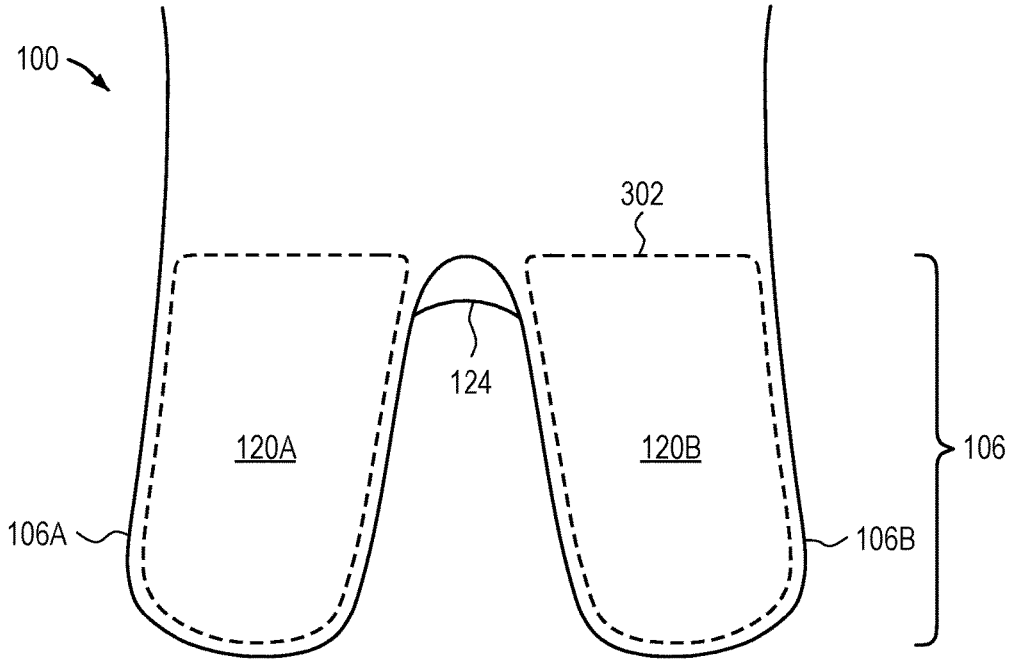
FIG. 3 illustrates a front view of one embodiment of a reinforcement region of the aquatic body cover of FIG. 1.

FIG. 3 illustrates a front view of one embodiment of a reinforcement region of the aquatic body cover of FIG. 1. Representatively, in this embodiment, reinforcement region 120, includes reinforcement members 102A, 102B which are positioned on booties 106A, 106B, respectively. Reinforcement members 102A, 102B may be of a size and shape suitable for covering the top or bottom sides of the user's feet when they are positioned within booties 106A, 106B. For example, reinforcement members 102A, 102B may have a shape similar to that of the top or bottom of a foot, and be positioned along a top side or a bottom side of booties 106A, 106B. Reinforcement members 102A, 102B may be made of any material suitable for providing reinforcement and/or additional padding between the user's feet and a monofin in which they are positioned. For example, reinforcement members 102A, 102B may be made of a same material as booties 106A, 106B and include one or more material layers for added reinforcement and/or padding. Alternatively, reinforcement members 102A, 102B may be made of a different material that is thicker, softer, or otherwise provides the desired reinforcement and/or padding, that can not be achieved by the material of booties 106A, 106B, alone. Reinforcement members 102A, 102B may be sewn to an interior or exterior surface of booties 106A, 106B along line 302, such that they remain at a desired location on booties 106A, 106B.

Figure 4:
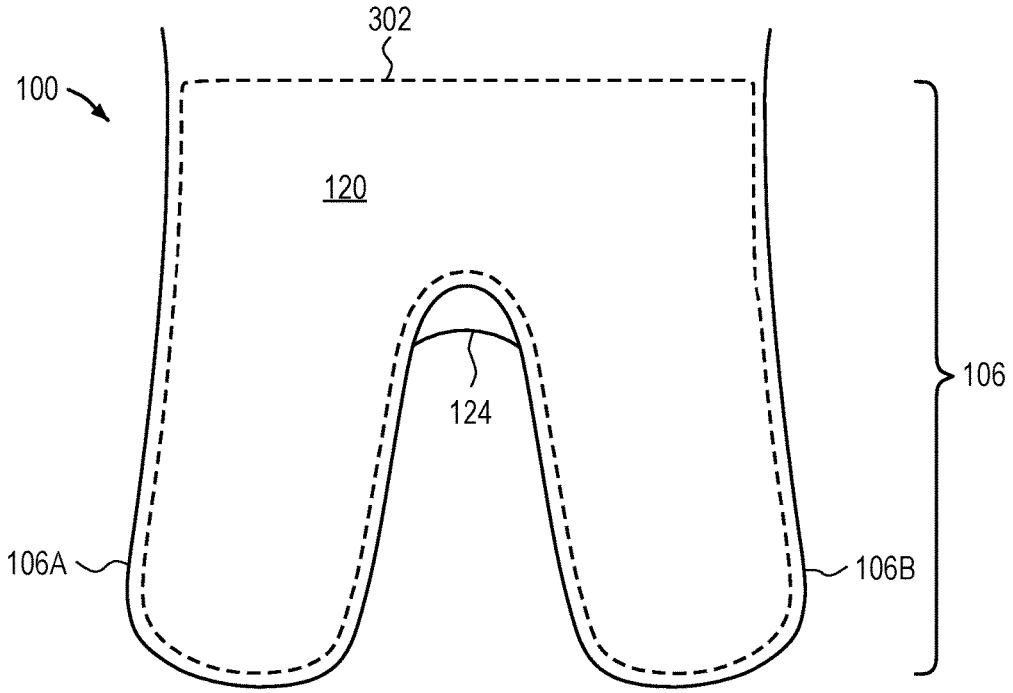
FIG. 4 illustrates a front view of another embodiment of a reinforcement region of the aquatic body cover of FIG. 1.

FIG. 4 illustrates a front view of another embodiment of a reinforcement region of the aquatic body cover of FIG. 1. Representatively, in this embodiment, reinforcement region 120 is a single piece reinforcement member positioned across both booties 106A, 106B. In addition, reinforcement member 120 extends along the entire foot portion 106 length such that it covers a greater portion of the user's feet, for example, reinforcement member 120 may be dimensioned to cover both the feet and ankles of the user, as previously discussed. Reinforcement member 120 may be positioned along a top side or a bottom side of booties 106A, 106B. Reinforcement member 102 may be made of a same, or different, material than that of booties 106A, 106B and sewn to booties 106A, 106B along line 302 to hold it in place, as previously discussed.

Figure 5:
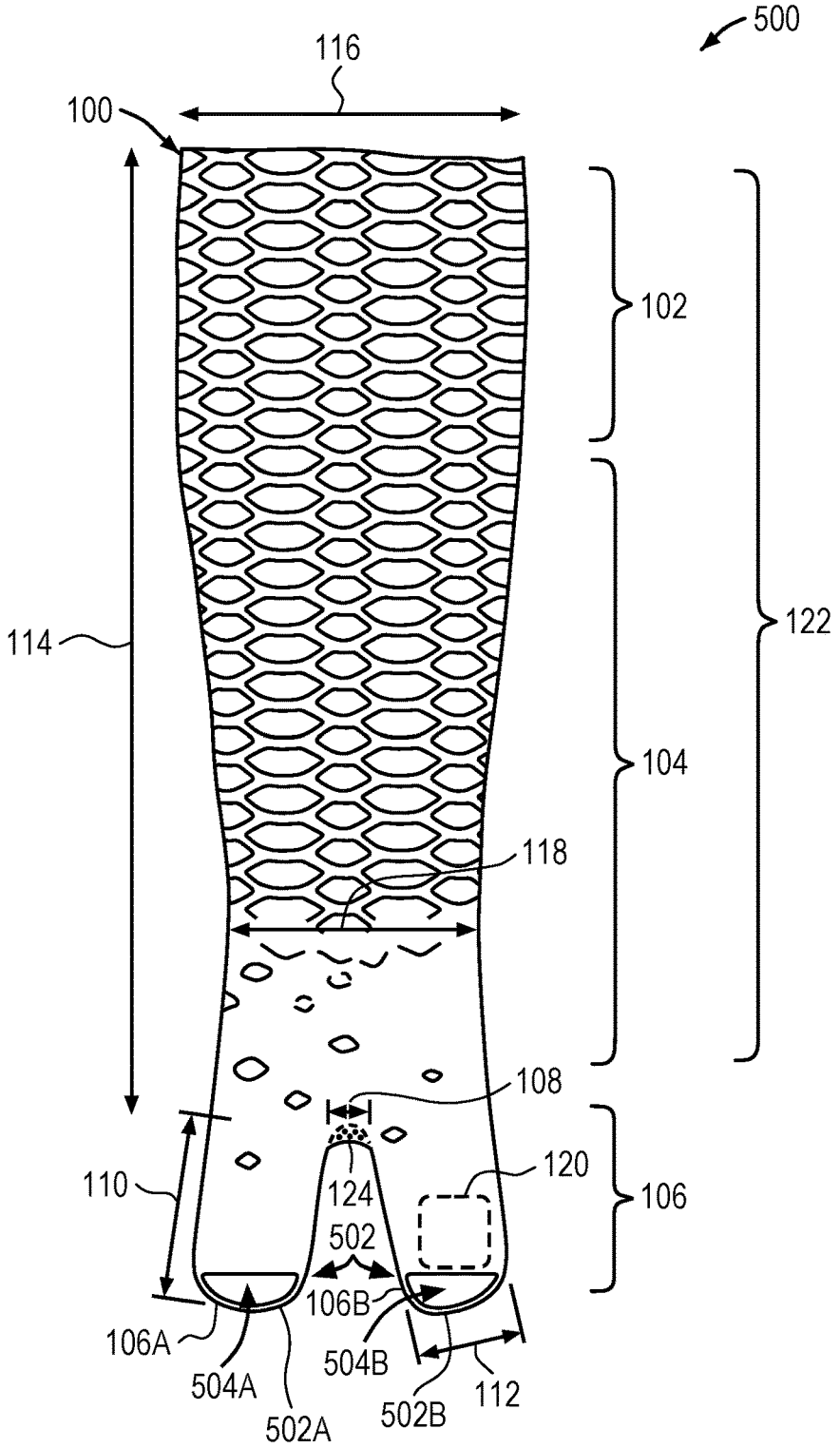
FIG. 5 illustrates a front view of another embodiment of an aquatic body cover.

FIG. 5 illustrates a front view of another embodiment of an aquatic body cover. The aquatic body cover is a mermaid tail skin 500, which is substantially similar to, and includes similar features as, mermaid tail skin 100 discussed in reference to FIG. 1. In this embodiment, however, mermaid tail skin 500 includes booties 106A, 106B having stirrups 502. In particular, the ends of booties 106A, 106B include openings 504A, 504B, which are enclosed by straps 502A, 502B. In this aspect, when the user wears mermaid tail skin 500, the feet are positioned through openings 504A, 504B, and straps 502A, 502B go under, and support the bottom of the user's feet. Therefore, unlike the closed booties of FIG. 1 which entirely cover the user's feet, the feet in this embodiment are exposed through the bottom of booties 106A, 106B. Straps 502A, 502B may be made of the same material as the rest of mermaid tail skin 500 such that they are integrally formed with skin 500, or a different material and then sewn to the open bottom of booties 106A, 106B.

Figure 6:
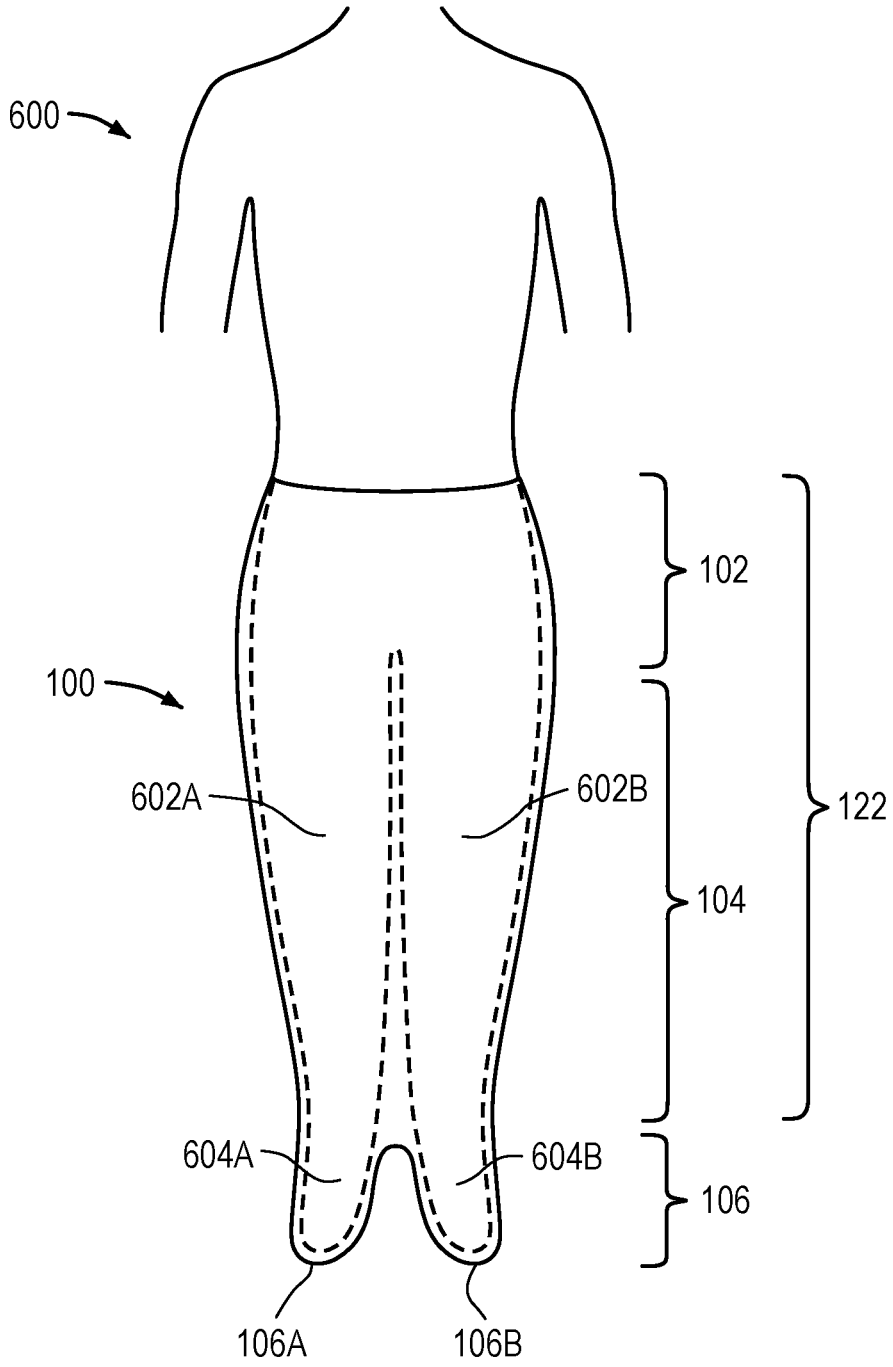
FIG. 6 illustrates a front view of an aquatic body cover worn by a person.

FIG. 6 illustrates a front view of an aquatic body cover, for example the aquatic body cover of FIG. 1 (or FIG. 5), worn by a person. In particular, from this view, it can be seen that when the mermaid tail skin 100 is worn by a user 600, the lower torso section 102 extends from the waist line or hip region to just below the buttock region of the user 600, the leg section 104 extends along the user's legs 602A, 602B, and the booties cover the user's feet 604A, 604B. In addition, it can be seen that the leg section 104 holds the legs 602A, 602B together, but booties 106A, 106B separately cover each of feet 604A, 604B. In this aspect, the user's feet 604A, 604B along with booties 106A, 106B can be inserted within each of the foot pockets of a monofin as shown in FIG. 7.

Figure 7:
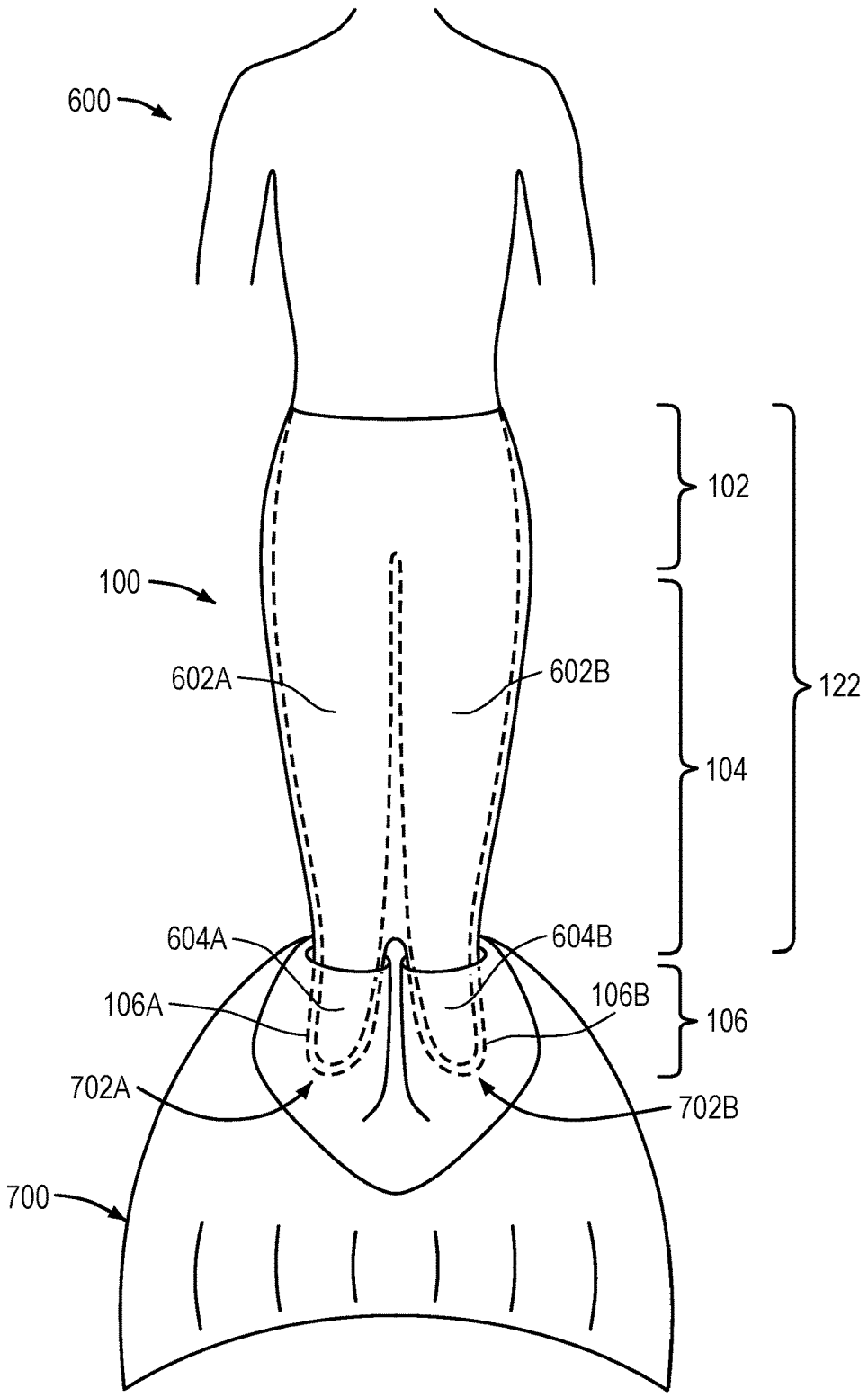
FIG. 7 illustrates a front view of the aquatic body cover of FIG. 6 in combination with a monofin.

In particular, FIG. 7 illustrates a front view of the aquatic body cover of, for example FIG. 1 or FIG. 5, worn by a person with the booties inserted into a monofin. From this view, it can be seen that monofin 700 includes foot pockets 702A, 702B. It can further be seen that once the user's feet 604A, 604B are inserted into booties 106A, 106B, of the mermaid tail skin 100, they can then be separately inserted into each of the monofin foot pockets 702A, 702B as shown. It can further be seen that booties 106A, 106B of mermaid tail fin 100 are tucked entirely within the monofin foot pockets 702A, 702B such that none of the mermaid tail fin 100 covers or otherwise overlaps monofin 700.

In the preceding detailed description, specific embodiments are described. It will, however, be evident that various modifications and changes may be made thereto without departing from the broader spirit and scope of the claims. The specification and drawings are, accordingly, to be regarded in an illustrative rather than restrictive sense.

What is claimed is:

1. An aquatic body cover for use with a monofin, the body cover comprising:

a sleeve portion dimensioned to cover a region of a human body extending from a waist to an ankle of the human body and hold the legs substantially together; and a foot portion integrally formed with an end of the sleeve portion, wherein the foot portion comprises a first bootie and a second bootie, the first bootie and the second bootie being dimensioned to separately cover each foot of the human body and allow for movement of one foot with respect to the other.

2. The cover of claim 1, wherein the sleeve portion comprises a tapered shape such that the sleeve portion is narrower near the foot portion than an end of the sleeve portion near the waist.

3. The cover of claim 1, wherein the sleeve portion is longer than the foot portion.

4. The cover of claim 1, wherein at least one of the first bootie or the second bootie comprises a length dimension that is less than a length dimension of the sleeve portion.

5. The cover of claim 1, wherein at least one of the first bootie or the second bootie comprises a length of 20 inches or less.

6. The cover of claim 1, wherein at least one of the first bootie or the second bootie comprises a width of 10 inches or less.

7. The cover of claim 1, wherein a spacing between the first bootie and the second bootie is at least 0.5 inches.

8. The cover of claim 1, wherein the first bootie and the second bootie are dimensioned for insertion within a first foot pocket and a second foot pocket, respectively, of a monofin.

9. The cover of claim 1, wherein at least one of the first bootie or the second bootie entirely encloses the foot of the user.

10. The cover of claim 1, wherein at least one of the first bootie or the second bootie is open at an end integrally formed within the sleeve portion and entirely closed at an opposite end.

11. The cover of claim 1, wherein at least one of the first bootie or the second bootie is open at an end integrally formed within the sleeve portion and comprises a stirrup at an opposite end, wherein the stirrup is dimensioned to be positioned under the foot.

12. The cover of claim 1, wherein the sleeve portion and the foot portion are formed from one single piece of material.

13. The cover of claim 1, wherein the sleeve portion and the foot portion are formed from a same material selected from the group consisting of swim fabric, neoprene, 2-way stretch fabric, 4-way stretch fabric, spandex, rubber, plastic or a silicone material.

14. The cover of claim 1, wherein the sleeve portion and the foot portion comprise a seam joined together with hook and loop fasteners, zippers, buttons, clips, snaps, pins, hooks, stitches, magnets, ties, laces, adhesives or other fasteners or closures.

15. The cover of claim 1, wherein the foot portion further comprises:

a reinforcement portion within the foot portion that is aligned with an ankle, a heel or bottom of a foot when the foot is inserted into the foot portion.

16. A swimmable mermaid tail skin comprising:

a sleeve portion having a tubular shape dimensioned to cover portions of a torso and legs of a user; and a foot portion extending from an end of the sleeve portion, wherein the foot portion comprises a first bootie and a second bootie that are spaced a distance from one another, the first bootie and the second bootie dimensioned to separately cover each foot of the user and each of the first bootie and the second bootie having a length dimension less than that of the sleeve portion.

17. The mermaid tail skin of claim 16, wherein the sleeve portion and the foot portion are formed of a same material suitable for use in an aquatic environment.

18. The mermaid tail skin of claim 16, wherein the foot portion comprises an overall width less than that of a monofin.

19. The mermaid tail skin of claim 16, wherein the first bootie and the second bootie form closed pockets at the end of the sleeve portion, and the closed pockets are dimensioned to completely enclose each foot of the user and allow for movement of one foot with respect to another foot.

20. The mermaid tail skin of claim 16, wherein the tubular shape is tapered toward the end of the sleeve portion.

* * * * *